United States Patent [19]

Duke, Jr. et al.

[11] Patent Number: 4,553,785

[45] Date of Patent: Nov. 19, 1985

[54] LOUNGE CHAIR COVER

[76] Inventors: George B. Duke, Jr.; S. Mark Pierce, both of 1677 Dylan Dr., Virginia Beach, Va. 23464

[21] Appl. No.: 534,608

[22] Filed: Sep. 22, 1983

[51] Int. Cl.[4] ..... A47C 31/10

[52] U.S. Cl. ..... 297/229; 297/188

[58] Field of Search ..... 297/229, 218, 219, 188, 297/441, 451, 231

[56] References Cited

U.S. PATENT DOCUMENTS

| | | | |
|---|---|---|---|
| 1,777,275 | 9/1930 | Goodman | 297/188 |
| 2,557,874 | 6/1951 | Kailenta | 297/230 |
| 2,722,967 | 11/1955 | Reinholz | 297/441 |
| 2,797,743 | 7/1957 | Rodtz | 297/229 |
| 3,042,467 | 7/1962 | Germick | 297/188 |
| 3,062,586 | 11/1962 | Rowland | 297/231 |
| 3,078,101 | 2/1963 | Reese | 297/219 X |
| 3,151,909 | 10/1964 | Gerdetz | 297/188 |
| 3,479,085 | 11/1969 | Weinstein | 297/219 |
| 4,050,491 | 9/1977 | Hargrove | 297/188 |
| 4,273,380 | 6/1981 | Silvestri | 297/229 |

*Primary Examiner*—Francis K. Zugel

*Attorney, Agent, or Firm*—B. P. Fishburne, Jr.

[57] ABSTRACT

A readily removable and washable cover for a beach lounge chair includes opposing end pockets which are slipped over cantilevered ends of the lounge chair. Between the end pockets is a contiguous panel which covers the seat area of the lounge chair. Depending free-hanging skirt portions on opposite sides of the cover are equipped with convenience pockets in ready reach of a user. Head pillow securing straps and slits enabling the attachment of a side table to the lounge chair can be included.

1 Claim, 3 Drawing Figures

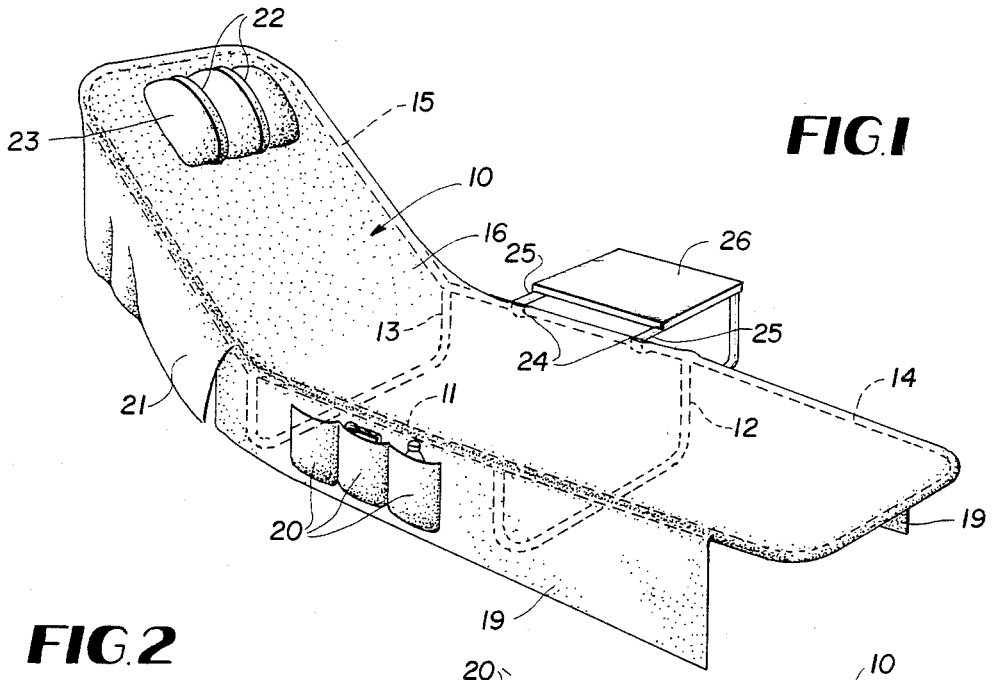
FIG. 1
FIG. 2
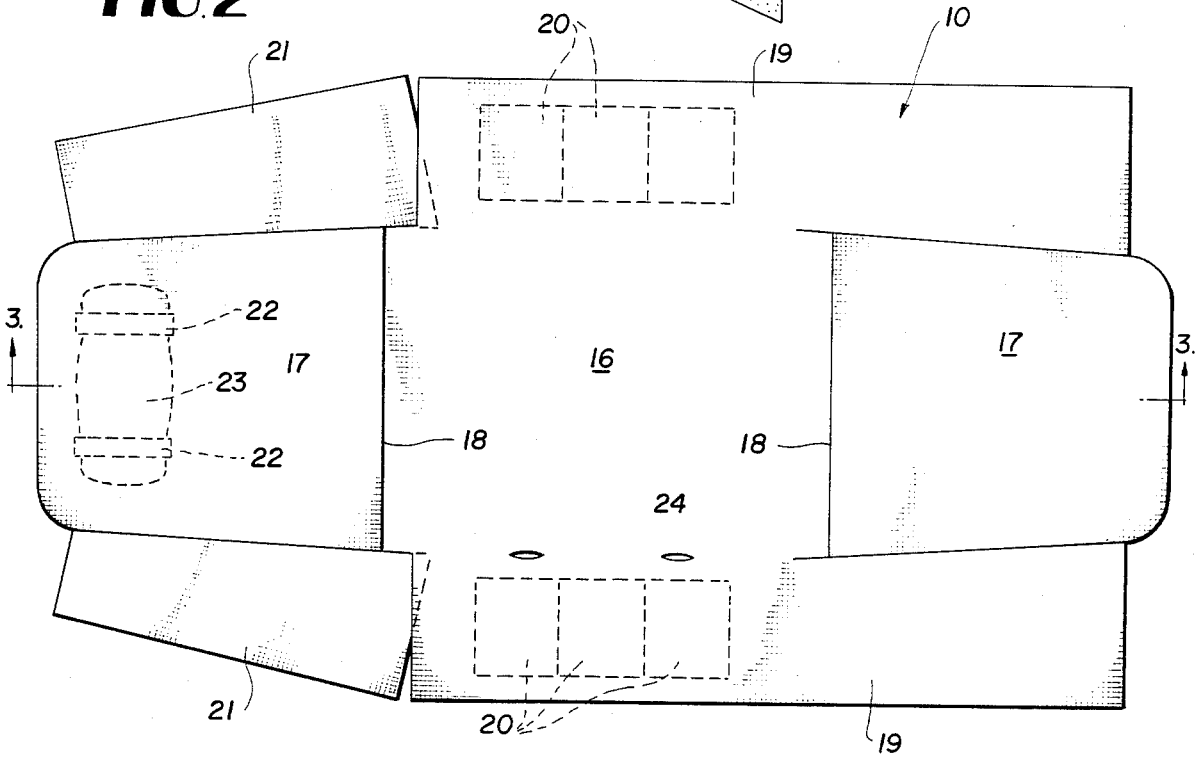
FIG. 3
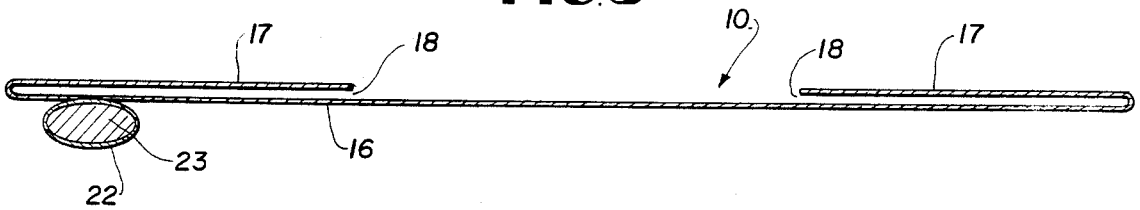

LOUNGE CHAIR COVER

BACKGROUND OF THE INVENTION

The object of this invention is to provide an economical, convenient and very practical cover for a folding lounge chair of a type commonly used on beaches or lawns by sunbathers. Such lounge chairs are equipped with body support surfaces formed of plastics elements which tend to be uncomfortable in extremely cool or warm weather. The cover according to the invention can be formed of terry cloth which is very comfortable and absorbent and also easy to launder.

The lounge chair includes leg portions disposed at the forward and rear ends of the seat area, and two folding upper body and leg support portions are cantilevered rearwardly and forwardly of the seat area and leg portions. The cover which is unitary includes spaced opposing inwardly open pockets which fit snugly over the two cantilevered extensions of the lounge chair to secure the cover thereto with stability so that it will not become displaced during normal usage.

Pocketed skirts on opposite sides of the cover add to its convenience and appearance, the skirts concealing the legs of the lounge chair during usage. Head pillow anchoring straps and slits near one side of the cover to enable the use of a side table attachment are optional features which may be omitted in some cases.

U.S. Pat. No. 4,273,380 discloses a beach accessory in the nature of a combined beach towel, chair cover and tote bag and is the closest known prior art structure. The patented device lacks a number of the features possessed by the present invention and has a different mode of use, and accordingly it is an object of the present invention to improve on the device of U.S. Pat. No. 4,273,380 particularly in connection with a folding lounge chair of the type disclosed in the patent.

Other objects and advantages of the invention will become apparent during the course of the following detailed description.

BRIEF DESCRIPTION OF THE DRAWINGS

FIG. 1 is a perspective view of a lounge chair cover according to the invention applied to a folding lounge chair.

FIG. 2 is a bottom plan view of the cover in a flat laid-out state.

FIG. 3 is a longitudinal vertical section taken on line 3—3 of FIG. 2.

DETAILED DESCRIPTION

Referring to the drawings in detail wherein like numerals designate like parts, a lounge chair cover 10 according to the invention is preferably formed of terry cloth or stretch terry cloth in any desirable color or combination of colors. Other fabrics can be employed to make the cover if preferred.

The cover 10 is constructed particularly for use on a folding lounge chair of the type shown in FIG. 1 and in the above-referenced patent. Such a lounge chair includes a horizontal seat portion 11 bounded by forward and rear folding legs 12 and 13. Forward and rear cantilevered leg and upper body supports 14 and 15 extend forwardly and rearwardly of the legs 12 and 13 and are also foldable and angularly adjustable, as is well known.

The cover 10, which is a unitary device and entirely flexible, is constructed to completely cover the folding lounge chair and to be stably engaged therewith so that the cover does not shift and slide during use. The cover adds considerably to the comfort and convenience of the lounge chair during use on a beach or the like. It is very easy to apply to the lounge chair and to remove therefrom for laundering. No fastener elements of any type are required to anchor the cover to the lounge chair.

The cover 10 includes a center longitudinal body portion whose upper surface covers entirely the upper body support section 15, the seat section 11, and the leg support section 14, FIG. 1. The body portion of the cover is designated by the numeral 16 in the drawings.

On its lower side, FIG. 2, at its opposite ends, in opposing relationship, is a pair of pockets 17 whose interior ends 18 are open. These pockets are slightly tapered to conform to the shapes of the cantilevered chair frames or sections 14 and 15 over which they engage snugly, as shown in FIG. 1. The intervening area of the body portion 16 between the two pockets 17 covers the horizontal seat section 11 of the lounge chair.

Integrally attached to the opposite sides of the body portion 16 adjacent to the seat and leg sections 11 and 14 are free-hanging side skirts or flaps 19, each equipped on its outer side adjacent to the seat area with several top opening convenience or utility pockets 20, capable of holding a variety of items used on the beach. The pockets 20 and skirts 19 are formed of the same material used for the body portion of the cover 10. Additional side skirts 21 are preferably attached to opposite sides of the upper body section of the cover to improve the overall appearance of the device. The skirts 21 could also be used, if desired, to wipe suntan lotion from the hands.

Preferably, a pair of spaced head pillow support straps 22 are attached by stitching or the like to the body portion 16 near the end of upper body section 15 of the lounge chair. A head pillow 23 is placed removably within the straps, if desired.

An optional feature of the invention resides in providing in the body portion 16 adjacent to one side of seat section 11 a pair of spaced slits 24 arranged to receive therethrough the two support arms 25, FIG. 1, of an optional foldable side table 26 which can be used with the folding lounge chair to support a drink or the like, if desired.

A chief attribute and feature of the cover is its ability to remain stably fixed on the lounge chair without shifting or sliding during usage. This ability distinguishes the invention from any known prior art devices. Attempts to cover a lounge chair with a large conventional beach towel are entirely unsatisfactory for the reason that the towel will not remain in place.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A cover for a folding lounge chair comprising an elongated body portion of textile fabric of a shape and size to completely cover the top surfaces of a folding lounge chair, opposite end pockets on the bottom of the body portion formed by panels of flexible sheet material and having open interior ends in opposing relationship toward the longitudinal center of the body portion, said pockets being closed at their outer ends and sides and the pockets conforming to the shape of corresponding end portions of said body portion, opposite side free-hanging skirts on the body portion and having utility pockets thereon which are open at their tops when the skirts are hanging substantially vertically at opposite sides of the body portion, and the body portion having a pair of slits formed therethrough in longitudinally spaced relationship near one side thereof adapted to receive support arms of an attachable side table and a pair of spaced head pillow support straps attached near one end of the body portion.

* * * * *